United States Patent [19]

Shirakura et al.

[11] Patent Number: 5,073,798

[45] Date of Patent: Dec. 17, 1991

[54] ELECTRONIC PHOTOGRAPHY APPARATUS

[75] Inventors: Akira Shirakura; Takao Tsuchiya; Haruo Watanabe; Koichi Kawasumi, all of Kanagawa, Japan

[73] Assignee: Sony Corporation, Shinagawa, Japan

[21] Appl. No.: 625,886

[22] Filed: Dec. 11, 1990

[30] Foreign Application Priority Data

Dec. 13, 1989 [JP] Japan ..... 1-323434

[51] Int. Cl.[5] ..... G03G 15/06

[52] U.S. Cl. ..... 355/245; 118/647; 118/659; 355/256; 355/261

[58] Field of Search ..... 355/245, 261, 264, 256; 118/647

[56] References Cited

U.S. PATENT DOCUMENTS 2,911,944 11/1959 Hayford et al. ..... 355/264 X
4,398,818 8/1983 Jeromin et al. ..... 355/256
4,622,915 11/1986 Ohtsuka et al. ..... 355/256 X

FOREIGN PATENT DOCUMENTS 0094260 4/1988 Japan ..... 355/256
0094285 4/1988 Japan ..... 355/264

*Primary Examiner*—A. T. Grimley
*Assistant Examiner*—J. E. Barlow, Jr.
*Attorney, Agent, or Firm*—Lewis H. Eslinger; Jay H. Maioli

[57] ABSTRACT

Electronic photography apparatus has a photoconductor material on which an electrostatic latent image is formed, a developing device for developing the electrostatic latent image formed on this photoconductive material, a developing electrode provided in the developing device for developing the electrostatic latent image, a developers such that the developer supply exists in the spacing between the photoconductor material and the developing electrode and an injecting means for injecting air to the developers remaining in the spacing between the photoconductor material and the developing electrode so that the developers remaining in the spacing between the photoconductor material and the developing electrode are blown out before they become dried, and changed into solid developers. In another embodiment in which a developer supplying container for storing developers supplied to the spacing between the photoconductor material and a developer discharging container for storing the developers discharged from the spacing between the photoconductive material are used and a developing electrode and the circulating path is provided independently of the two containers for supplying the developers to the spacing between the photoconductive material and the developing electrode, the electrostatic latent image can be developed by a very small amount of developers without irregularity.

7 Claims, 3 Drawing Sheets

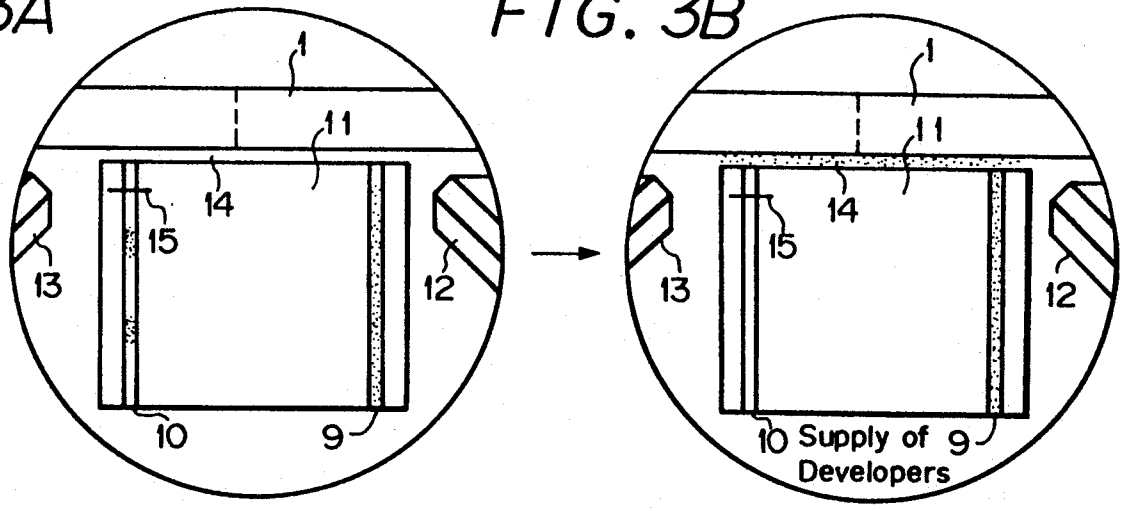
FIG. 3A
FIG. 3B
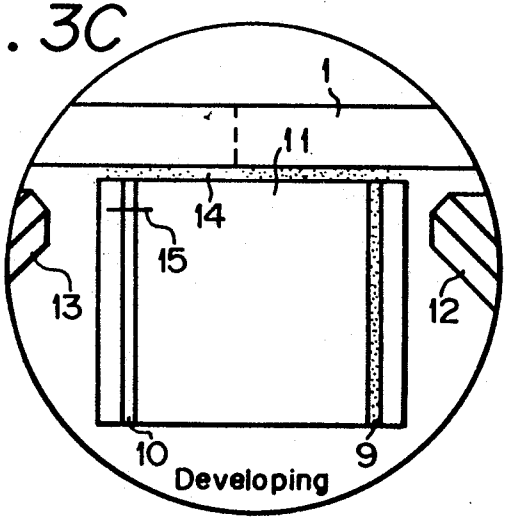
FIG. 3C
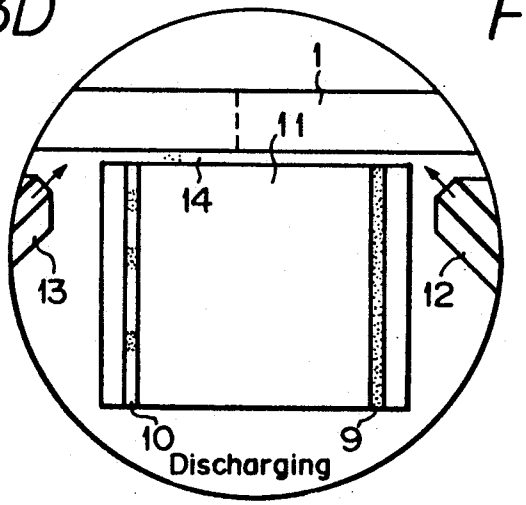
FIG. 3D

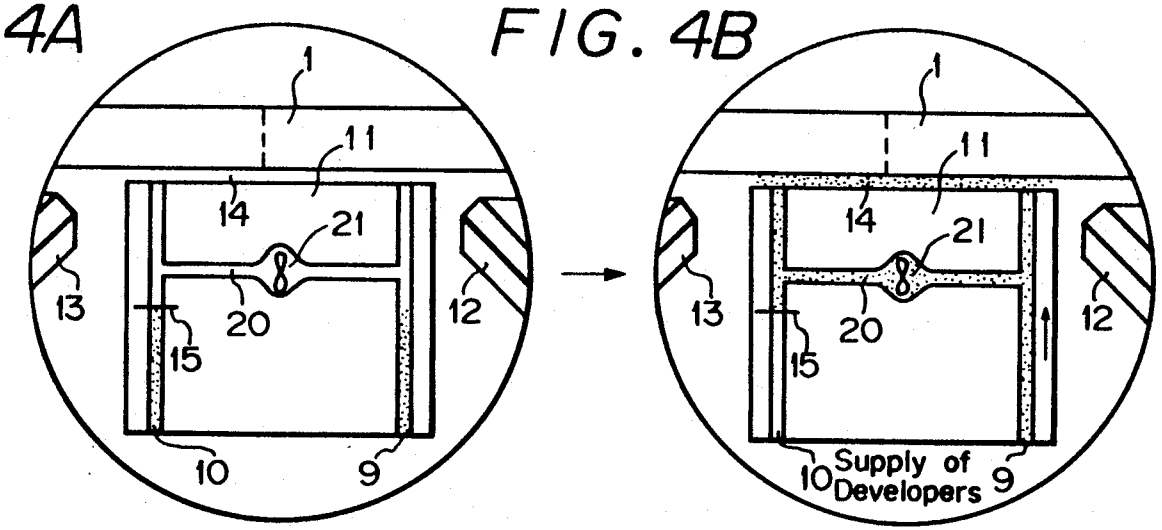
FIG. 4A
FIG. 4B
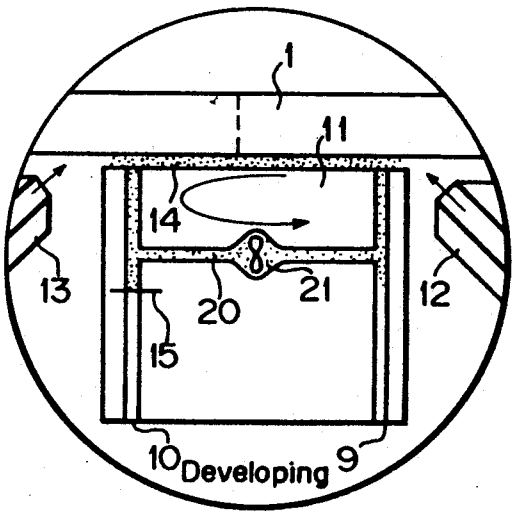
FIG. 4C
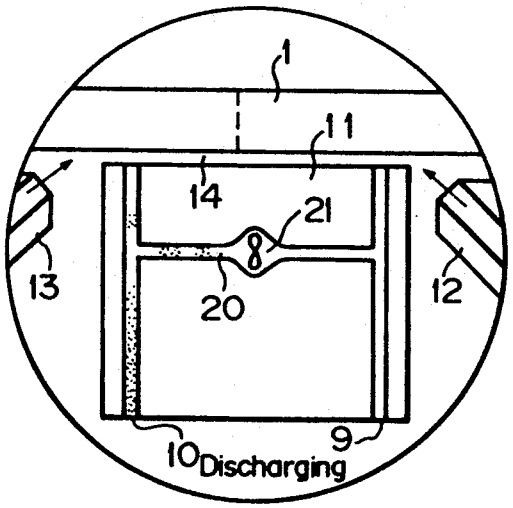
FIG. 4D

ELECTRONIC PHOTOGRAPHY APPARATUS

BACKGROUND OF THE INVENTION

1. Field of the Invention

The present invention relates generally to electronic photography apparatus and, more particularly, to an electronic photography apparatus suitable for use in developing an electrostatic latent image in an electronic photography process or similar process.

2. Description of the Prior Art

In the electrostatic process such as an electronic photograph developing process or similar process, an electrostatic latent image is formed in such a manner that a photoconductive material such as a photoconductor is uniformly electrified (charged) and then selectively illuminated by a light in accordance with an image signal, so that charges on the portion illuminated by the light are extinguished. Alternatively, a dielectric material such as a paper, a plastic film or similar element is electrified by an electrostatic electrode called a multistylus head in response to an image signal, thereby forming an electrostatic latent image. In order to develop this electrostatic latent image, a toner or developer charged to the polarity opposite to that of the electrostatic latent image carrier (photoconductor drum, dielectric film and so on) having the electrostatic latent image is electrostatically deposited on the electrified portion of the photoconductor drum and then developed.

As a developing method, a dry type developing system using a dry developer and a wet type developing system using liquid developer are known. The dry developer is generally formed of very small particle powders. For this reason, if the dry developer is scattered, a problem of environmental disruption occurs. To solve this problem, a developer cartridge in which the dry developer is accommodated should be constructed as a sealed type. Today, most of the developing apparatus are of such a type that an electrostatic latent image carrier that the developing portion are wholly removed and replaced. Therefore, this type of developing apparatus is expensive but the dry developer is excellent in preservation and if the developer is accommodated within the developer cartridge, it is easy to handle.

On the other hand, the liquid developer is formed by dispersing into an insulating liquid powders of colorant such as dye stuff and the like. By a centrifugal pump or the like, the liquid developer is injected from the developer container through the slit of a developing electrode used to charge the electrostatic latent image to the polarity opposite to that of the electrostatic latent image carrier, whereby colored particle powders are electrostatically deposited on the electrostatic latent image carrier. In the conventional developing apparatus, extra liquid developers, which are not deposited on the electrostatic latent image carrier, are returned to and accommodated again within the developer container, rendering the colorant powders in the liquid developers low in concentration. This makes control of the concentration of the developing liquid (liquid developer) difficult. Further, various problems arise such that pollution occurs due to the leakage of liquid developer in the developing process or when the developing apparatus is held or when the liquid developer is exchanged and that the preservation of the liquid developer is difficult because the colored particle in the powders of the liquid developer tend to coagulate and precipitate. The electrostatic process utilizing the liquid developer has a possibility that resolution and gradation of picture thereof will be increased to levels equal to those of silver halide photograph. Therefore, this electrostatic process is expected to be the electrostatic latent image developing system which is suitably applied to a printing apparatus of high image quality such as a video printer used in an electronic still camera or the like.

In regard to the background set forth so far, the assignee of the present application has previously proposed a method of developing an electrostatic latent image (see Japanese Patent Application No. 63-156847). This previously-proposed method can solve various problems, such as that the liquid developer is difficult to handle, the liquid developer tends to be smudged, the maintenance of liquid developer is difficult and the preservation of liquid developer is poor while making effective use of advantages of the electrostatic process using the liquid developer. In other words, this electrostatic latent image developing method is characterized by a developer (i.e. toner) which is formed by a colorant dispersed into an electrostatic insulating organic material that is solid at normal temperature and when heated is changed into liquid, in which an electrostatic latent image is developed by the thus liquefied developer in a wet developing fashion.

FIG. 1. shows a cross-sectional view of a conventional developing apparatus that is described, for example, in Japanese Patent Published Gazette No. 64-6462.

In FIG. 1, reference numeral 30 designates supporting portions 31 a photoconductor film extended between the supporting portions 30, 32 a preserving tank, 33 a developing liquid preserved in this preserving tank 32, 34 a developing roller, 35 a liquid lifting member, 36 an injection opening portion, 37 a developing electrode, 38 a spring and 39 a bias voltage source.

The developing liquid 33 from the preserving tank 32 is lifted by the rotation of the developing roller 34 via the liquid lifting member 35, injected from the injection opening portion 36 and is filled in the space between the developing electrode 37 and the photoconductor film 31 for development. After the development, the developing liquid 33 is returned to the preserving tank 32 and subsequently utilized several times for the development.

Incidentally, in the case of the conventional apparatus described in Japanese Patent No. 63-156847, if the developing electrode is located closer to the photoconductor drum, the developing is more effectively promoted but the amount of the developer (developing liquid) flowing into the developing space is reduced. Thus, the optimum value exists there. Further, if the developing electrode is too close to the photoconductor drum, the developer forms a meniscus (film formed by surface tension) between the photoconductor material and the developing electrode after the supply of developers is stopped, and this waste developer cannot be discharged. If the waste developer becomes dried and solidified on the photoconductor material, the apparatus cannot be cleaned when it is actuated again. Further, a service life of the photoconductor material and the developing electrode is reduced and a trouble occurs in the apparatus when the apparatus is actuated again.

In the case of the conventional apparatus disclosed in Japanese Patent Published Gazette No. 64-6462, since the developing liquid returned to the preservation tank several times, the composition of the developing liquid (developer) is changes due to aging, resulting in an image quality being deteriorated. Furthermore, if the developing liquid is left for a long period of time, the developers are precipitated and a dispersion property of the developer is deteriorated.

OBJECTS AND SUMMARY OF THE INVENTION

Accordingly, it is an object of the present invention to provide an improved electronic photography apparatus which can eliminate the aforenoted shortcomings and disadvantages encountered with the prior art.

More specifically, it is an object of the present invention to provide an electronic photography apparatus which can avoid a defect such that developers remaining at a spacing between a photoconductor material and a developing electrode are dried and solidified to cause trouble when the apparatus is actuated again.

It is another object of the present invention to provide an electronic photography apparatus in which a photoconductor material, a developing electrode or the like can be improved.

It is still another object of the present invention to provide an electronic photography apparatus in which an electrostatic latent image can be developed by a very small amount of developers without irregularity and an electronic photograph of excellent image quality can be obtained.

As a first aspect of the present invention, an electronic photography apparatus is comprised of a photoconductor material on which an electrostatic latent image is formed, a developing device for developing the electrostatic latent image formed on the photoconductor material, a developing electrode provided in the developing device for developing the electrostatic latent image, a means for supplying developers such that the developers exist in a spacing between the photoconductor material and the developing electrode, and an injection means for injecting air to the developers existing at the spacing between the photoconductor material and the developing electrode.

In accordance with a second aspect of the present invention, an electronic photography apparatus is comprised of a photoconductor material on which an electrostatic latent image is formed, a developing device for developing the electrostatic latent image formed on the photoconductor material, a developing electrode provided in the developing device for developing the electrostatic latent image, a developer supplying container for storing therein developers supplied to the spacing between the photoconductor material and the developing electrode, a developer discharging container for storing therein developers discharged from the spacing between the photoconductor material and the developing electrode, and a circulating path provided independently of the two containers for supplying the developers to the spacing between the photoconductor material and the developing electrode.

The above, and other objects, features and advantages of the present invention will be apparent in the following detailed description of illustrative embodiments to be read in conjunction with the accompanying drawings, in which like reference numerals are used to identify the same or similar parts in the several views.

BRIEF DESCRIPTION OF THE DRAWINGS

FIGS. 3A-3D are schematic diagrams each showing a main portion of the electronic photography apparatus of FIG. 2 in an enlarged scale, respectively; and FIGS. 4A-4D are schematic diagrams each showing a main portion of a second embodiment of the electronic photography apparatus according to the present invention, respectively.

DETAILED DESCRIPTION OF THE PREFERRED EMBODIMENTS

Figure 1:
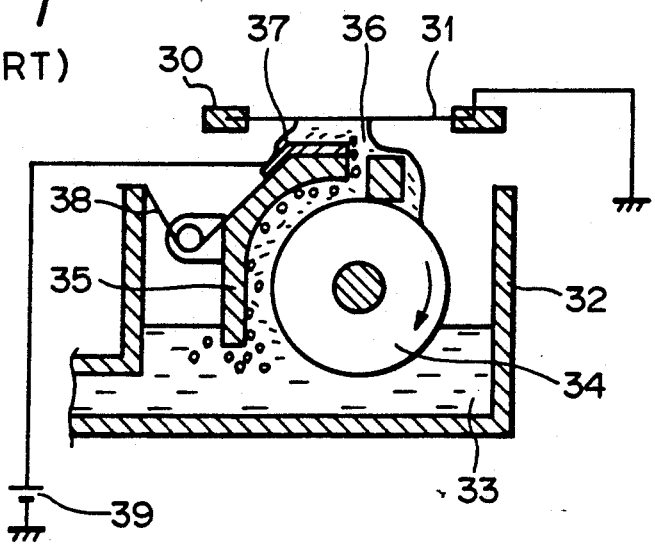
FIG. 1 (PRIOR ART)
FIG. 1 is a diagrammatic view of a section illustrating an example of a conventional developing apparatus utilized in an electronic photography apparatus.

Referring to the drawings in detail, and initially to FIG. 2 and FIGS. 3A-3D, a first embodiment of the electronic photography apparatus according to the present invention will be described hereinafter.

Figure 2:
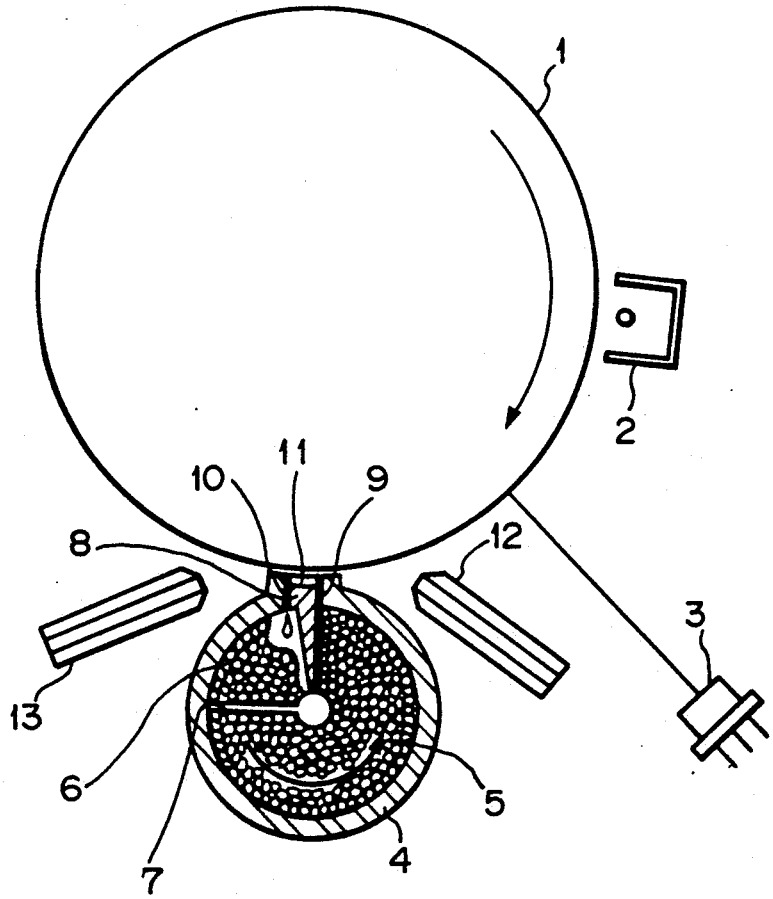
FIG. 2 is a schematic diagram showing a first embodiment of an electronic photography apparatus according to the present invention.

Referring to FIG. 2, there is provided a photoconductor drum 1 having a photoconductor material (such as a base material that can carry an electrostatic latent image) is wrapped around a cylindrical-shaped circumferential surface of the drum 1. A charging device 2 is provided to uniformly charge the entire surface of the photoconductor material on the drum 1 in, for example, negative charges. A semiconductor laser (light exposure system) 3 is provided to selectively illuminate the surface of the photoconductor material on the drum 1 with a laser beam in response to a video signal so that charges at the portion illuminated by the laser beam are erased to form an electrostatic latent image. A developer tank 4 contains therein solid developers. Reference numeral 5 designates particles of solid developers that are which are not yet used and 6 designates particle solid developers used. Reference numeral 7 designates an isolation member which is rotatable and 8 a stationary wall which incorporates therein a heater (not shown) to liquefy (melt) the solid developers 5 by the heating-process. Reference numeral 9 designates an inlet through which the solid developers 5 are supplied and 10 an outlet from which waste solid developers 6 are discharged. Reference numeral 11 designates a developing electrode which charges the solid developers 5 in polarity opposite to that of the photoconductor material. Reference numerals 12 and 13 designate nozzles from which air is injected to remove solid developers remaining in a narrow spacing between the photoconductor drum 1 and the developing electrode 11 by air pressure at the completion of the developing process.

Liquid developer in which the particles of solid developers are heated by the heater and liquefied is supplied through the inlet 9 so as to fill in the narrow spacing between the photoconductor drum 1 and the developing electrode 11 for carrying out the developing process. According to the arrangement of the first embodiment of the present invention, even when the supply of liquid developer is stopped and the outlet 10 is opened after the developing process, the liquid developer remaining at the above-described narrow spacing can be prevented from being exhausted due to its surface tension. Accordingly, the remaining liquid developers can be discharged and collected by supplying the air from the air nozzles 12 and 13 to the spacing after the developing process.

FIGS. 3A-3D show the main portion of the present invention, i.e. the portion near the developing electrode 11 in FIG. 2, in an enlarged scale, respectively.

When a sensitized portion in which an electrostatic latent image is recorded following electrification and exposure is supplied to the developing apparatus (see FIG. 3A), the liquid developer is supplied from the inlet 9 and filled into a narrow spacing 14 between the photoconductor drum 1 and the developing electrode 11 as shown in FIG. 3B. The developing process is carried out under this condition (see FIG. 3C). Even when the supply of liquid developer is stopped, or even when a valve 15 is opened to open the outlet 10 after the developing process is ended, the liquid developer remaining at the spacing 14 is not discharged due to its surface tension. Accordingly, when the air is injected to the spacing 14 from the air nozzles 12 and 13, the remaining liquid developer is discharged to the direction of the outlet 10 (FIG. 3D).

As described above, according to this embodiment, since the supply of the liquid developer is stopped at every picture, it is possible to avoid such a problem that, when the developing apparatus is not in use, the liquid developer remaining at the spacing between the photoconductor material and the developing electrode is dried and solidified to cause trouble in the restarting of the apparatus. Further, according to the present embodiment, the service life of the photoconductor material, the developing electrode and the like can be increased.

FIGS. 4A–4D show a second embodiment of the electronic photography apparatus according to the present invention. In FIGS. 4A to 4D, like parts corresponding to those of FIG. 2 and FIGS. 3A to 3D are marked with the same references and therefore need not be described in detail.

In the second embodiment, as illustrated, a circulating path 20 is coupled between the discharging path and the supplying path so that the toner (developer) flows through the circulating path 20 only in one direction. A pump 21 is provided in the intermediate portion of the circulating path 20 so as to force the solid developer remaining at the spacing 14 to be circulated, whereby the solid developer remaining at that spacing 14 is discharged to the outside of the apparatus at every developing process.

This operation will be explained from a time standpoint. When the sensitized portion on which the electrostatic latent image is recorded after having been electrified and exposed is fed to the developing apparatus (FIG. 4A), the developer is supplied from the inlet 9 and is filled in the spacing 14 between the photoconductor drum 1 and the developing electrode 11. At that time, the pump 21 is in its stopped condition (FIG. 4B). Then, the pump 21 is driven to force the developer to be circulated through the circulating path 20 and the developing is carried out (FIG. 4C). If the developer tends to be dispersed from the spacing 14, the developer may be suppressed from being dispersed by air pressure from the air nozzles 12 and 13.

After the development of one picture is ended (the developer may be used two to three times if the composition thereof is not unsatisfactory), air is supplied to the spacing 14 from the nozzles 12 and 13 to thereby discharge the circulated developer (FIG. 4D).

As described above, according to this embodiment, since the circulating path through which the developer is supplied to the spacing between the photoconductor portion and the developing electrode is provided in the path independently of the developer supplying and exhausting tanks and the developer is forced to be circulated through this circulating path, it becomes possible to perform uniform development using only a very small amount of the developer.

While the solid developer supplying container and the solid developer discharging container are formed as a unitary body in the above-described embodiment, they may be provided independently.

As set cut above, according to the present invention, since the electronic photography apparatus is comprised of the photoconductor material on which an electrostatic latent image is formed, a developing device for developing the electrostatic latent image formed on this photoconductive material, a developing electrode provided in the developing device for developing the electrostatic latent image, a means for supplying developers such that the developers exist in the space between the photoconductor material and the developing electrode and an injecting means for injecting air to the developers remaining in the spacing between the photoconductor material and the developing electrode, it is possible to solve the problem in which developers remaining in the spacing between the photoconductor material and the developing electrode are dried and changed into solid developers upon non-use, resulting in trouble when the electronic photography apparatus is started again. Also, a service life of the photoconductor material, the developing electrode or the like can be improved.

According to another aspect of the present invention, since the electronic photography apparatus is comprised of the photoconductor material on which an electrostatic latent image is formed, a developing device for developing the electrostatic latent image formed on the photoconductor material, a developing electrode provided in this developing device for developing the electrostatic latent image, a developer supplying container for storing therein developers supplied to the spacing between the photoconductor material and the developing electrode, a developer discharging container for storing therein the developers discharged from the spacing between the photoconductive material and the developing electrode and the circulating path provided independently of the two containers for supplying the developers to the spacing between the photoconductive material and the developing electrode, the electrostatic latent image can be developed by a very small amount of developers without irregularity and therefore the electronic photograph of good image quality can be obtained.

Having described the preferred embodiments of the invention with reference to the accompanying drawings, it is to be understood that the invention is not limited to those precise embodiments and that various changes and modifications thereof could be effected by one skilled in the art without departing from the spirit or scope of the novel concepts of the invention as defined in the appended claims.

We claim as our invention:

1. An electronic photography apparatus comprising:

a) a photoconductor material on which an electrostatic latent image is formed;

b) a developing device for developing said electrostatic latent image formed on said photoconductor material;

c) a developing electrode provided in said developing device and spaced apart from said photoconductor material for developing said electrostatic latent image;

d) means for supplying developers to reside in a spacing between said photoconductor material and said developing electrode; and e) injection means operating independently of said means for supplying developers for injecting air to the spacing and for removing said developers residing in the spacing between said photoconductor material and said developing electrode.

2. An electronic photography apparatus comprising:

1) a photoconductor material on which an electrostatic latent image is formed;

2) a developing device for developing said electrostatic latent image formed on said photoconductor material;

3) a developing electrode provided in said developing device and spaced apart from said photoconductor material for developing said electrostatic latent image;

4) a developer supplying container for storing therein developers and for supplying said developers to the spacing between said photoconductor material and said developing electrode through a supply channel;

5) a developer discharging container for receiving and storing therein developers discharged from the spacing between said photoconductor material and said developing electrode through a discharge channel; and 6) an intermediate circulating path provided independently of said developer supplying and developer discharging containers and connecting said discharge channel with said supply channel for supplying said developers from said discharge channel through said supply channel to the spacing between said photoconductor material and said developing electrode.

3. The electronic photography apparatus according to claim 1, wherein said means for supplying developers includes a tank containing solid particles of the developers.

4. The electronic photography apparatus according to claim 3, wherein said means for supplying developers further includes heater means to liquify the solid particles of the developers, so the developers reside in liquid form in the spacing between said photoconductor material and said developing electrode.

5. The electronic photographic apparatus according to claim 4, wherein said photoconductor material is in the form of a drum spaced apart from said developing electrode so that the spacing therebetween extends longitudinally of said drum, and wherein said injection means comprises two nozzles arranged on either side of said developing electrode and aimed at the spacing whereat the developers reside for injecting air and removing remaining developers upon completion of the developing process.

6. The electronic photographic apparatus according to claim 2, wherein said developers are in liquid form and said intermediate circulating path includes an intermediate channel connected to said discharging channel and to said supplying channel and a pump for forcing said developers through said intermediate channel.

7. The electronic photographic apparatus according to claim 6, wherein said developer discharging container includes a valve in said discharging channel arranged downstream of the connection with said intermediate channel.

* * * * *